US006278099B1

(12) United States Patent
Kang

(10) Patent No.: US 6,278,099 B1
(45) Date of Patent: Aug. 21, 2001

(54) COOLING STRUCTURE FOR VENTILATION-HOODED MICROWAVE OVENS

(75) Inventor: Myung Yeol Kang, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/633,787

(22) Filed: Aug. 7, 2000

Related U.S. Application Data

(63) Continuation-in-part of application No. 08/996,233, filed on Dec. 22, 1997.

(30) Foreign Application Priority Data

Mar. 8, 1997 (KR) ..... 1997-7839

(51) Int. Cl.[7] ..... H05B 6/64
(52) U.S. Cl. ..... 219/757; 126/21 A
(58) Field of Search ..... 219/757, 681, 219/756, 678, 733; 126/21 A, 21 R, 198; 426/234

(56) References Cited

U.S. PATENT DOCUMENTS

| | | | | |
|---|---|---|---|---|
| 4,332,993 | | 6/1982 | Shibahara et al. . | |
| 4,369,347 | | 1/1983 | Shin . | |
| 4,549,054 | | 10/1985 | Aoyama et al. . | |
| 4,549,055 | * | 10/1985 | Kohler | 219/757 |
| 4,623,771 | * | 11/1986 | Sakino | 219/757 |
| 4,635,610 | | 1/1987 | Nkanishi . | |
| 4,786,774 | | 11/1988 | Kaminaka et al. . | |
| 4,812,617 | | 3/1989 | Takeuji et al. . | |
| 4,835,354 | * | 5/1989 | Collins et al. | 219/757 |
| 5,814,793 | * | 9/1998 | Yu | 219/757 |
| 5,847,377 | * | 12/1998 | Yang et al. | 219/757 |
| 5,869,818 | * | 2/1999 | Kim | 219/757 |
| 5,945,023 | * | 8/1999 | Yang | 219/756 |
| 5,981,929 | * | 11/1999 | Maeda et al. | 219/757 |

* cited by examiner

*Primary Examiner*—Tu Ba Hoang

(57) ABSTRACT

A cooling structure for ventilation-hooded microwave ovens including an instrument compartment separated from a cooking cavity. The instrument compartment includes a first electronic equipment piece positioned at an upper portion of the instrument compartment, and a second electronic compartment piece positioned at a lower portion of the instrument compartment. A fan assembly is mounted on an upper portion of the instrument compartment in the form of a slope. The fan assembly generates a downward air current to the first and second electronic equipment pieces.

12 Claims, 5 Drawing Sheets

COOLING STRUCTURE FOR VENTILATION-HOODED MICROWAVE OVENS

This application is a continuation-in-part of application Ser. No. 08/996,233 filed on Dec. 22, 1997, the entire contents of which are hereby incorporated by reference.

BACKGROUND OF THE INVENTION

1. Field of the Invention

The present invention relates, in general, to a cooling structure for a microwave oven, and more particularly, to an improved cooling structure for a ventilation-hooded microwave oven, which can effectively cool electronic equipment that generates microwaves.

2. Description of the Background Art

As well known to those skilled in the art, in a conventional OTR (over the range), a microwave oven is installed over a gas oven and generates microwaves to heat food in its cooking cavity. A collateral function of the microwave oven is to exhaust the smoke of the gas oven into the atmosphere.

FIG. 1 is a schematic view showing the construction of a conventional ventilation-hooded microwave oven.

As shown in FIG. 1, such a microwave oven comprises a cavity assembly 10, including a cavity 12 for cooking, and an instrument compartment 14 mounted to the outside wall of the cooking cavity 12. Electronic equipment is embedded in the instrument compartment 14 while an air duct 20 is mounted to the top portion of the cooking cavity assembly 10.

A magnetron mount plate 13 is protrusively mounted in the instrument compartment 14. Also, both the electronic equipment for generating microwaves and an exhaust passage serving to ventilate smoke are mounted in the instrument compartment 14.

A magnetron 16 for oscillating microwaves is fixed to the mount plate 13, while a high voltage transformer 11 for supplying a high voltage to the magnetron 16 is mounted to the rear panel 10*b* of the instrument compartment 14.

A lower panel 18, consisting of the lower portion of the instrument compartment 14, is mounted to the front and rear panels 10*a* and 10*b* using a plurality of screws. A fan motor assembly 15 is equipment for both radiating the heat of the electronic equipment and exhausting the smoke generated from the cooking cavity in cooking progress into the atmosphere. The fan motor assembly 15 is spaced apart from the right-side portion of the magnetron 16 by a predetermined gap. In addition, a condenser 19 is mounted in the instrument compartment 14, while an exhaust channel 18*a* for forming a separated exhaust passage is formed on the right-side portion of the lower panel 18 as shown in FIG. 1.

As mentioned above, after the electronic equipment is embedded in the instrument compartment 14, the electronic equipment is covered with an air guide plate 17 so that the exhaust passage is formed so as to connect the exhaust channel 18*a* to the air duct 20. That is, the right-side portion of the instrument compartment 14, corresponding to the exhaust channel 18*a* of the lower panel 18, is covered with the air guide plate 17, thereby forming the right-side portion of the instrument compartment 14 into the exhaust passage. Preferably, the guide plate 17 has an almost L-shaped cross-section.

An exhaust motor 22 is mounted around the rear portion of the air duct 20. The exhaust motor 22 serves to generate an air current at the exhaust passage, which communicates with a base panel 30 of the microwave oven, a part of the instrument compartment 14 and the rear portion of the air duct 20. An air intake port 24 is formed at the front side of the air duct 20 so that air is introduced into the interior of the instrument compartment 14 by the fan assembly 15 as described below.

FIGS. 2 and 3 are sectional views illustrating the mount construction of the conventional microwave oven shown in FIG. 1

As shown in FIG. 2, the fan assembly 15, serving to generate the air current, is mounted between the magnetron 16 and the high voltage transformer 11 at the intermediate height of the instrument compartment 14. In addition, as shown in FIG. 3, the fan assembly 15 is mounted at a position spaced apart from the right portion of the magnetron 16 so as to generate the air current for cooling the electronic equipment.

That is, the fan assembly 15 intakes the air through the air intake port 24 and introduces the air into the cooking cavity. The air, passed through the fan assembly 15, is separated into two air currents. The first air current flows toward the magnetron 16 mounted to the lower panel 18, while the second air current flows toward the transformer 11 mounted to the rear panel 10*b* of the instrument compartment 14. Thus, the electronic equipment is cooled by the introduction of the air current. Thereafter, such an air current is introduced into the cooking cavity 12 through a vent hole 12*b* formed on one-side wall 12*a* of the cavity 12. Subsequently, the air current is exhausted with the air of the cavity 12 into the atmosphere through a vent hole formed on the other side wall of the cavity 12 or the top portion of the cooking cavity 12.

However, such a conventional construction of the electronic equipment in the microwave oven has the problems described below.

The mounting position of both the magnetron 16 and the high voltage transformer 11 are different from each other, when viewed from the position of the fan assembly 15. That is, as show in FIG. 2, the magnetron 16 is mounted to the lower panel 18, while the transformer 11 is mounted to the rear panel 10*b* of the instrument compartment 14. Thus the amount of air current introduced for the magnetron 16 and the transformer 11 is separately introduced to both the magnetron 16 and the transformer 11. Also, when the air is introduced to both the magnetron 16 and the transformer 11, the direction of the air current has to be changed to have a predetermined angle to cool both the magnetron 16 and the transformer 11. Therefore, the cooling efficiency of the fan assembly 15 is reduced.

In addition, the fan assembly 15 is spaced apart from the air intake port 24 of the air duct 20. That is, the air passage, connecting the air intake port 24 to the fan assembly 15, is bent at an angle of 90°. Thus, the blowing ability of the fan assembly 15 is decreased by the long distance between the fan assembly 15 and the intake port 24. Also, due to the complexity of an intake air course, the energy of the air current is reduced during the flow into the fan assembly 15. Therefore, in order to intake a sufficient amount of air, the blowing force of the fan assembly 15 has to be increased. However, it is difficult to increase the blowing force of the fan assembly in the instrument compartment due to a limited area.

Also, in the fan assembly 15, a fan cover 15*a* has to be formed into a specifically bent shape suitable for introducing the cooling air into both the magnetron 16 and the transformer 11. Therefore, the construction of the fan assembly 15 is complicated.

SUMMARY OF THE INVENTION

Accordingly, the present invention has been made with the above problems occurring in the conventional art in mind, and an object of the present invention is to provide a cooling system for ventilation-hooded microwave ovens, which effectively cools electronic equipment in an instrument compartment.

In order to accomplish the above and other objects, the present invention provides a cooling system for microwave ovens including a cooking cavity, the system comprising: an instrument compartment separated from the cooking cavity; a first electronic equipment piece positioned at an upper portion of said instrument compartment; a second electronic equipment piece positioned at a lower portion of said instrument compartment; and a fan assembly mounted in said instrument compartment at a position above the first electronic equipment piece, said fan assembly generating an air current and supplying the generated air current to both the first and second electronic equipment pieces.

In the preferred embodiment of present invention, this cooling structure further comprises guide means for guiding the air current to the first electronic equipment piece. Such guide means can include an air current guide for guiding the air current to the first electronic equipment piece.

The air current guide comprises vertical and horizontal parts, the vertical part downwardly extending from a mount opening formed on an air duct, and the horizontal part extending from one end portion of the vertical part so as to introduce the air current to the first electronic equipment piece.

In another embodiment of present invention, said fan assembly is mounted in said instrument compartment in the form of a slope.

The first and second electronic equipment pieces are mounted to the front position of the instrument compartment, and an air guide plate having a plane shape, is mounted to the rear position of the instrument compartment. Thus an exhaust passage is formed between the air guide plate and a rear panel of the instrument compartment.

BRIEF DESCRIPTION OF THE DRAWINGS

The above objects, and other features and advantages of the present invention will be more clearly understood from the following detailed description taken in conjunction with the accompanying drawings, in which.

DETAILED DESCRIPTION OF THE PREFERRED EMBODIMENTS OF THE INVENTION

Figure 1:
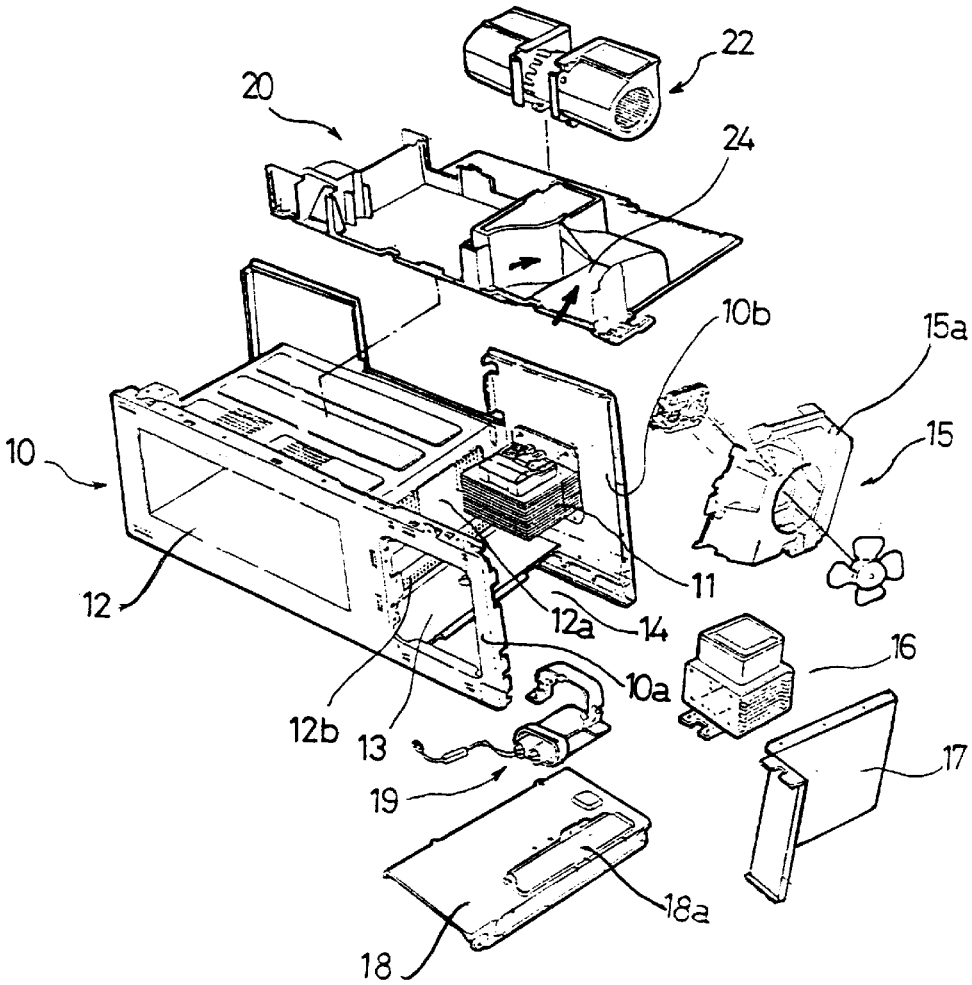
FIG. 1 is an exploded perspective view of a conventional ventilation-hooded microwave oven for OTRs.
Figure 2:
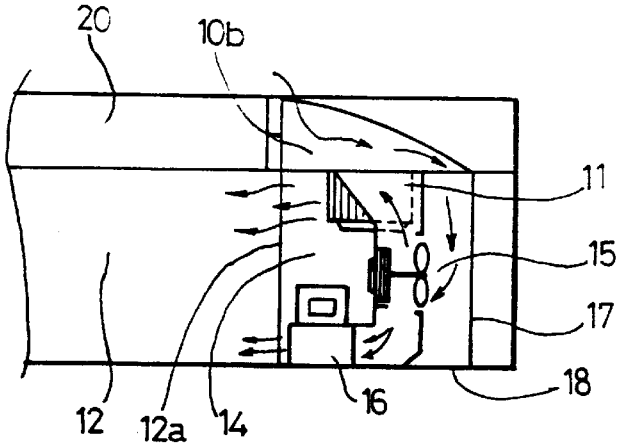
FIG. 2 is the longitudinal sectional view of a microwave oven in FIG. 1.
Figure 3:
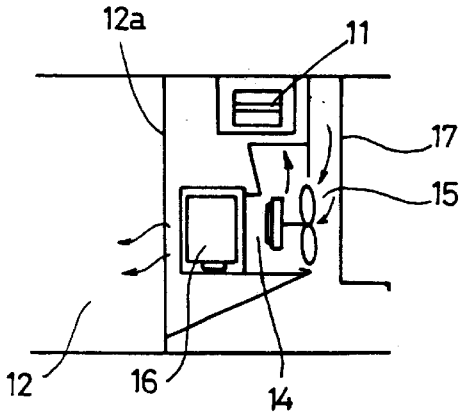
FIG. 3 is the horizontal sectional view of a microwave oven in FIG. 1.
Figure 4:
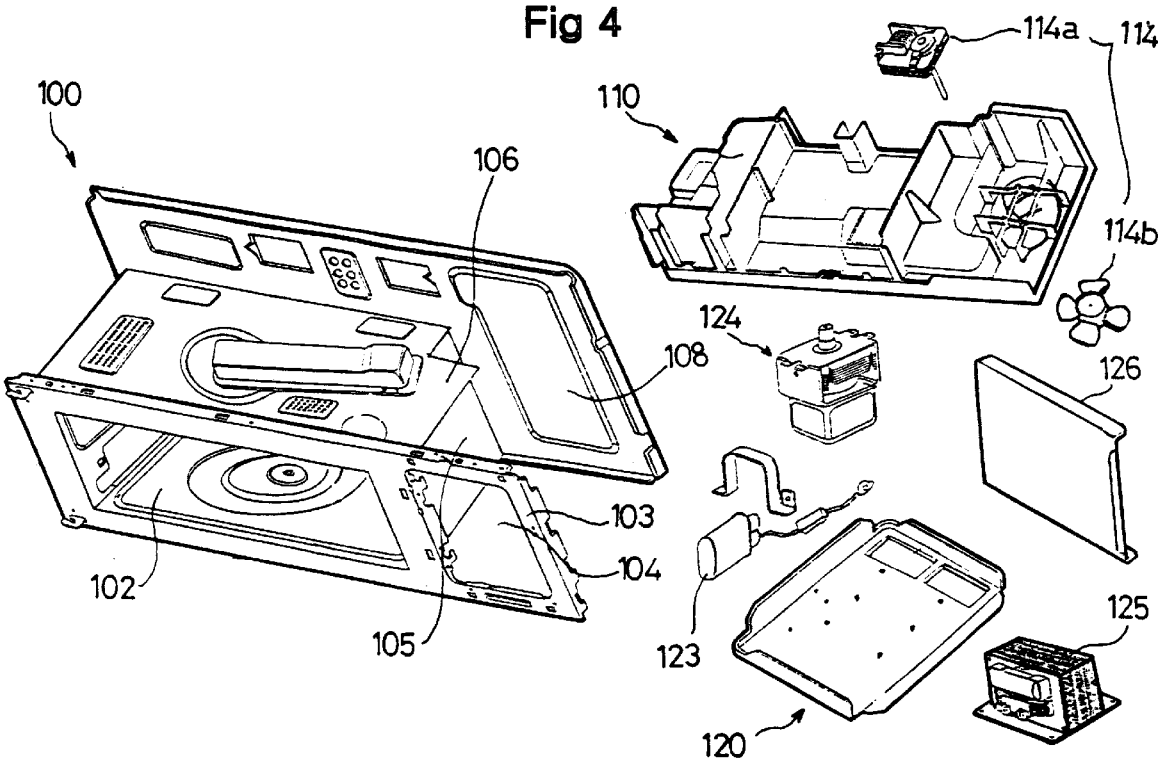
FIG. 4 is an exploded perspective view of a ventilation-hooded microwave oven for OTRs in accordance with the preferred embodiment of the present invention.

FIG. 4 is a view illustrating the construction of a microwave oven in accordance with the present invention.

In FIG. 4, an instrument compartment 104 is formed on the right position of a cooking cavity assembly 100. The instrument compartment 104 separated from both a cooking cavity 102 by a cavity wall 105. Also, a vent hole (not shown) is formed on the cooking cavity wall 105, while the instrument compartment 104 communicates with the cooking cavity 102 by the vent hole. A lower panel 120, including the lower portion of the instrument compartment 104, is mounted to the front and rear panels 107 and 108 of the compartment 104 by a plurality of screws.

The electronic equipment in the instrument compartment 104 is briefly described below.

A magnetron 124, generating microwaves, is supported by the right end of the upper portion 106 of the cooking cavity 102 (FIG. 5), when the upper portion of the instrument compartment 104 is mounted to the cooking cavity 102. Thus, due to such a magnetron 124, the invention remarkably improves the space utilization of the compartment 104 in comparison with the instrument compartment according to the conventional art.

Figure 5:
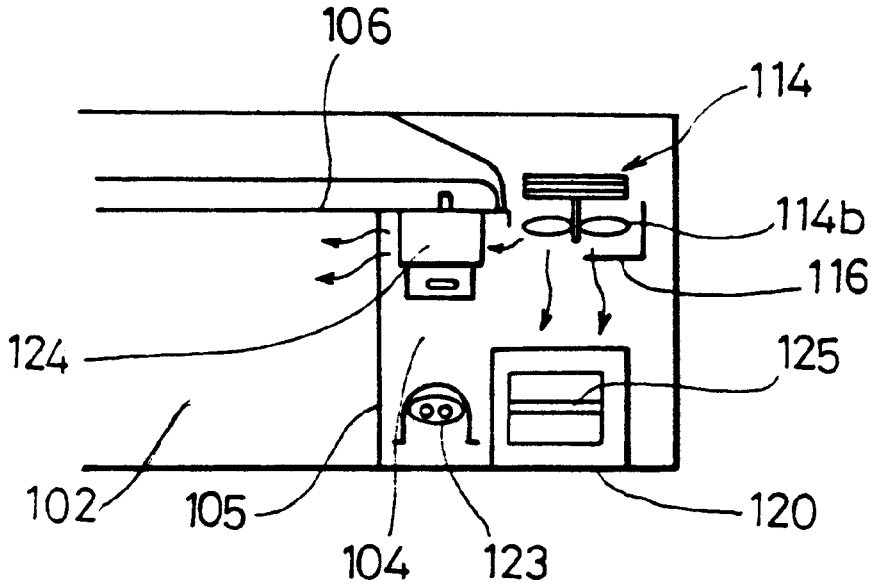
FIG. 5 is a longitudinal cross-sectional view of a microwave oven in accordance with the preferred embodiment of the present invention.

The electronic equipment, including such as a high voltage transformer 125 and a condenser 123 for supplying a high voltage to the magnetron 124, is mounted to the lower panel 120 by threading the screws through a plurality of screwing holes formed on the panel 120. In addition, as shown in FIG. 5, the electronic equipment for generating the microwave is mounted to both the upper portion 106 of the cooking cavity 102 and the lower portion 120 of the instrument compartment 104. Thus, such electronic equipment is effectively cooled by a fan assembly 114, which is mounted to an upper air duct 110 as described below.

Figure 6:
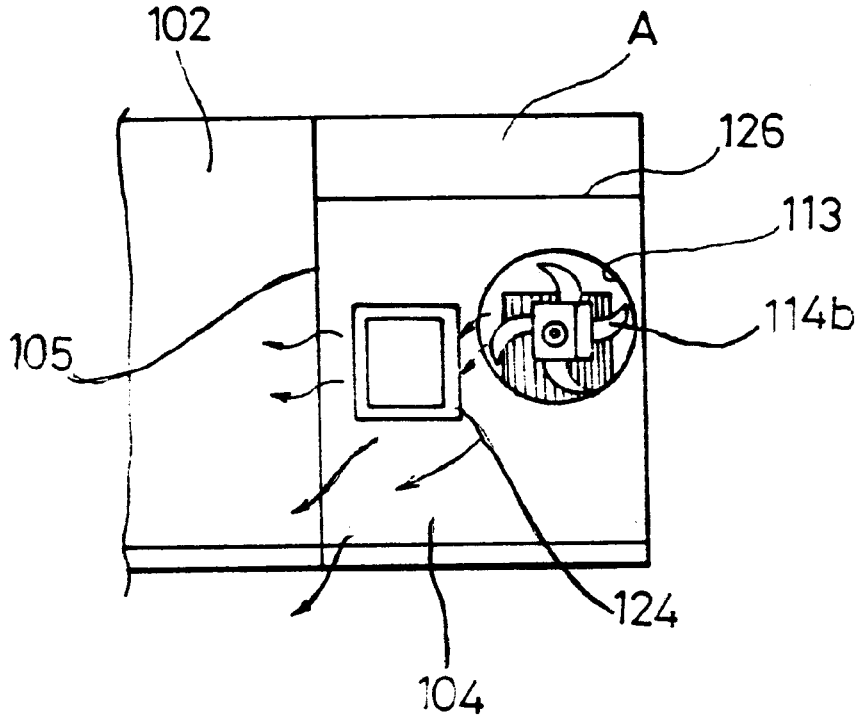
FIG. 6 is a horizontal sectional view (top view) of a microwave oven in accordance with the preferred embodiment of the present invention.

In addition, such electronic equipment is located at the front position of the instrument compartment 104, while an exhaust passage A is formed at the rear position of the compartment 104 by an air guide plate 126 as shown is FIG. 6. Such an exhaust passage A serves to exhaust smoke, generated from a gas oven, into the atmosphere by an exhaust motor mounted to the air duct 120. That is, the electronic equipment, including such as a magnetron, is mounted at the front position of the instrument compartment 104, while the exhaust passage A is formed between the air guide plate 126 and the rear panel 108 of the compartment 104.

A fan assembly 114, serving to cool the electronic equipment and to exhaust the smoke of the cavity 102 into the atmosphere, is mounted to the right-side position of the air duct 110. That is, the fan assembly 114 is positioned above the electronic equipment in the instrument compartment 104. Thus, the fan assembly 114 effectively cools the electronic equipment, mounted to the lower portion of the compartment 104.

Figure 7:
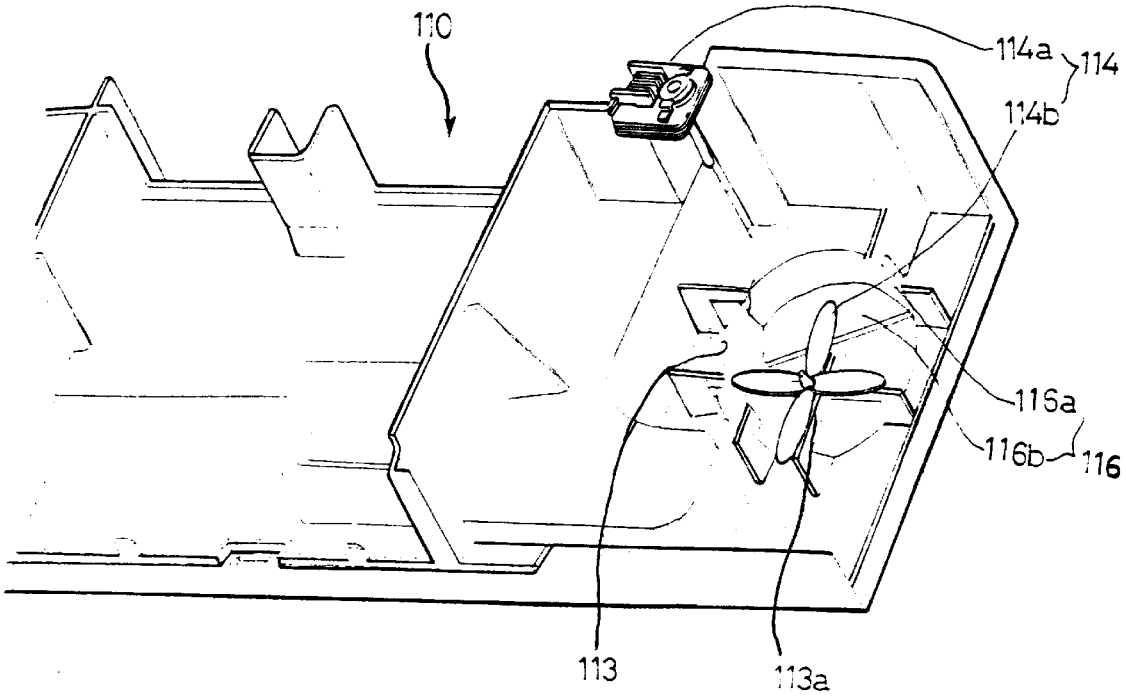
FIG. 7 is a perspective view of an air duct of a microwave oven in accordance with the preferred embodiment of the present invention.

As shown in FIG. 7 the fan assembly 114 of this invention is mounted to the right-side position of the air duct 110, thus downwardly introducing air into the compartment 104. Also, as mentioned above, the magnetron 124 is mounted in the compartment 104 at a position close to the fan assembly 114 because the magnetron 124 is mounted to the upper portion 106 of the cooking cavity 102 as shown in FIG. 5.

A support 113*a* for supporting the fan assembly 114 is formed on the upper portion of a mount opening 113, which is formed on the right-side portion of the air duct 110. Also, a fan 114*b* is mounted to the lower portion of a fan motor 114*a*, while the fan motor 114*a* is mounted to the support 113*a*, an air current guide 116, downwardly extending from the mount opening 113, is integrally formed at the mount opening 113. Thus, the air current, generated by the fan 114*b*, is introduced to both the magnetron 124 and the lower portion of the mount opening 113 by the air current guide 116.

Figure 8:
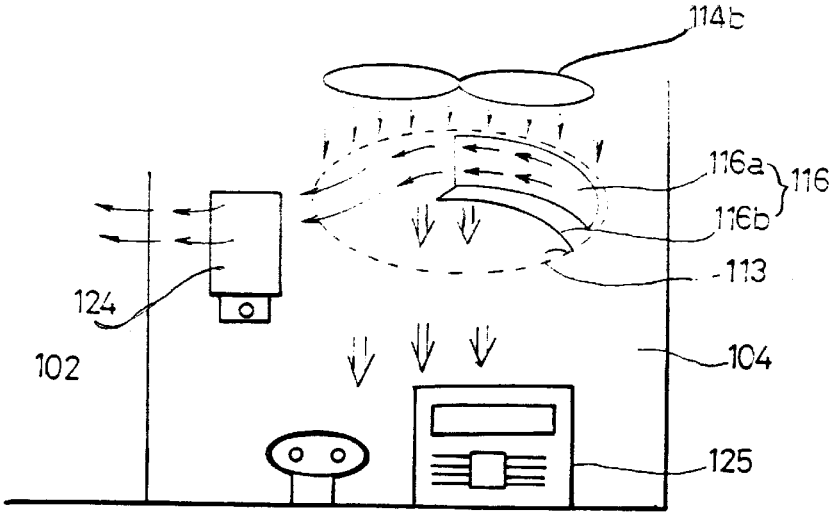
FIG. 8 is a view illustrating the flow of an air current in a microwave oven in accordance with the preferred embodiment of the present invention.

As shown in FIGS. 7 and 8, the guide 116 has vertical and horizontal parts 116*a* and 116*b*. The vertical part 116*a* downwardly extends along the edge portion of the mount opening 113 by a predetermined distance of 40 to 50 mm, while the horizontal part 116*b* is horizontally or perpendicularly bent from the vertical part 116*a*. The horizontal part 116*b* serves to guide the air current to the magnetron 124 located at a position opposite to the horizontal part 116*b*. Such vertical and horizontal parts 116*a* and 116*b* are formed on the lower edge portion of the mount opening 113. Also, the length of the vertical and horizontal parts 116*a* and 116*b* may be changed to the magnetron 124 and the transformer 125. Thus, the air is properly and sufficiently introduced by the rotation of the fan 114*b*.

Due to the air current guide 116 formed at the edge portion of the mount opening 113, one part of the air current is introduced along the vertical part 116*a* to the magnetron 124 after meeting the horizontal part 116*b*. The other part of the air current is introduced into the lower portion of the mount opening 113 without meeting the horizontal part 116*b*.

The flow of the air current in the microwave oven of this invention is described below.

When the microwave oven is turned on, the fan assembly 114, mounted to the air duct 110, is actuates. Thus, the fan 114*b* is rotated. Due to the rotation of the fan 114*b*, the air current for cooling the electronic equipment in the instrument compartment is generated at the lower portion of the fan 114*b*.

Such an air current is primarily introduced into the lower portion of the mount opening 113 of the air duct 110. Then, the air current around the edge portion of the mount opening 113, meets and guided by the horizontal part 116*b* of the guide 116. This air current is, thereafter, circularly rotated along the vertical part 116*a* from the horizontal part 116*b* of the guide 116 due to the inertia force of the fan 114*b*. Thereafter, the air current passes through the mount opening 113, at which the guidance of air may be terminated. The air current is then introduced to the magnetron 124 because the magnetron 124 is located at the upper position of the end portion of the guide 116. Such a flow of the air current is depicted in, e.g., FIG. 5.

In addition, the air current around the central portion of the mount opening 113 is introduced into the lower portion of the instrument compartment 104, thereby cooling the electronic equipment, including such as the high transformer 125 and the condenser 123 mounted to the lower panel 120.

The air current, passed by the above electronic equipment, is introduced into the cooking cavity 102 through a first vent hole (not shown) formed on one-side wall 105 of the cavity 102. Thereafter, such an air current is exhausted into the atmosphere through a second vent hole formed on the other side wall of the cooking cavity 102 along with the smoke generated from the cavity 102 during a cooking process.

As mentioned above, the fan assembly 114 is mounted to the air duct 110, which corresponds to the upper portion of the instrument compartment 104. Thus, the air current, generated by the fan assembly 114, is introduced downwardly into the lower portion of the instrument compartment 104. Such an air current is introduced to the magnetron 124 by the vertical and horizontal parts 116*a* and 116*b* of the guide 116, and into the lower panel 120. Also, the air current guide 116 may be altered without affecting the functions and operations of this invention, to guide the introduced air current to the magnetron 124 mounted to the upper portion 106 of the cooking cavity 102.

According to another embodiment of the present invention, a guide member for guiding the air current may be mounted in the instrument compartment 104 so as to guide the air current generated by the fan assembly 114 to the magnetron 124. That is, the guide member can be mounted to the lower portion of the air duct 110 in such a manner that the air current meets the guide member and is introduced to the magnetron 124 under the guide of the guide member.

Figure 9:
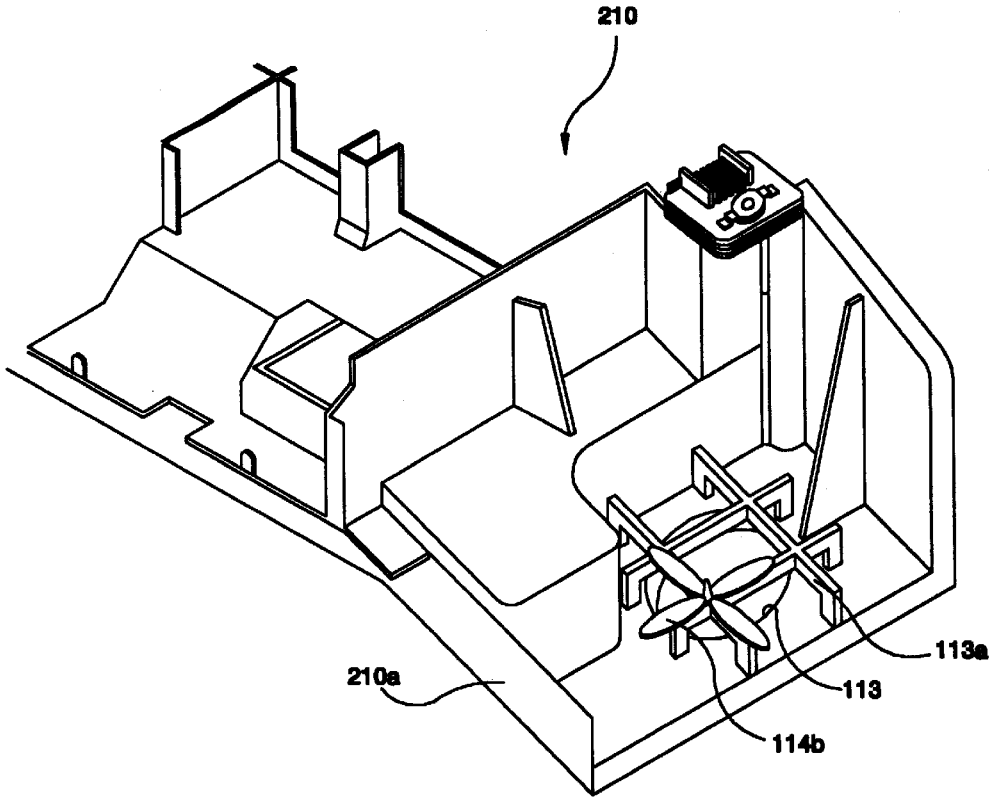
FIG. 9 is a view perspective view of an air duct of a microwave oven in accordance with another embodiment of the present invention.

According to another embodiment of the present invention, the fan assembly 114 is mounted in the instrument compartment 104 in the form of a slope. As shown in FIG. 9, the right-side portion of the air duct 210 is formed slope 210*a* downwardly and mount opening 113 is formed on the slope 210*a* of the air duct 210. A support 113*a* for supporting the fan assembly 114 is formed on the upper portion of the mount opening 113 and the fan assembly 114 is mounted to the support 113*a*. Therefore, an air current generated by rotating of the fan 114*b* is supplied directly to the magnetron 124 and the transformer 125 in the same time. In this case, the air guide is not formed.

The flow of the air current in the microwave oven of this embodiment is described below.

Figure 10:
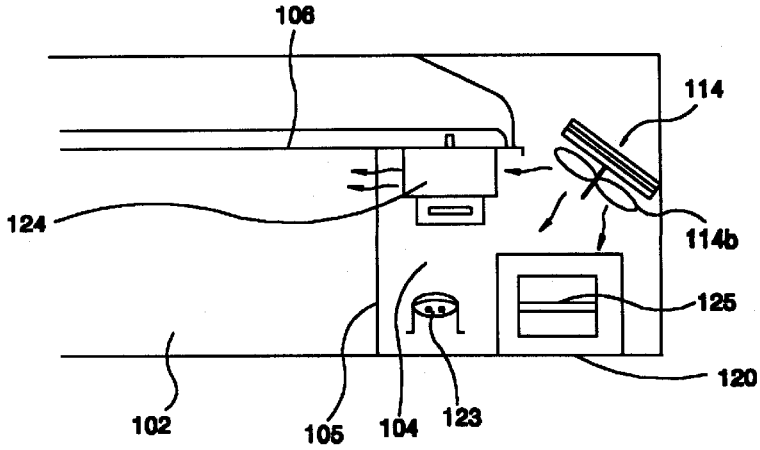
FIG. 10 is a horizontal sectional view (top view) of a microwave oven in accordance with another embodiment of the present invention.

Due to the rotation of the fan 114*b*, the air current for cooling the electronic equipment is introduced into the instrument compartment 104. As shown in FIG. 10, a portion of the air current flows toward the magnetron 124, which is located on the upper portion of the instrument compartment 104, and the remaining air current flows toward the lower portion of the instrument compartment 104. Therefore, the air current generated by the fan assembly 114 can simultaneously cool the magnetron 124 and the electronic equipment, including the high voltage transformer 125 and the condenser 123 mounted to the lower panel 120.

After passing by the electronic equipment, the air current is introduced into the cooking cavity 102 through a first vent hole (not shown) formed on one-side wall 105 of the cavity 102 and exhausted into the atmosphere through a second vent hole formed on the other side wall of the cooking cavity 102.

In addition, the position of the magnetron 124 may be directly exchanged with that of the high voltage transformer 125. That is, even when one piece of the electronic equipment (e.g., the magnetron 124 or the transformer 125) is mounted to the upper portion of the instrument compartment 104 and the other piece of electronic equipment is mounted to the lower panel 120, the air current is concurrently and effectively introduced to all pieces of the electronic equipment.

As mentioned above, the cooling structure for ventilation-hooded microwave oven in accordance with the present invention is provided with a cooling fan mounted to the upper portion of an instrument compartment, thereby allowing the air current to be introduced to one piece of the electronic equipment (a magnetron, etc.) mounted to the upper portion of the instrument compartment and to another piece of the electronic equipment mounted to the lower panel. As a result, the fan for cooling the different pieces of the electronic equipment is mounted at a position at which an air current is easily introduced from the atmosphere. Thus, the cooling efficiency of the microwave oven is increased by the operation of the fan assembly.

In addition, even when the rotation speed of the fan is reduced, the cooling effects for the electronic equipment is maintained. Also, the intake force of the air is improved, thereby minimizing operational noises and vibrations according to both the rotation of the fan and the flow of the air current.

The electronic equipment may be mounted to the front portion of the instrument compartment, while the air guide having plane or other shape may form the rear portion of the compartment into an exhaust passage. As a result, the construction of the exhaust passage, serving the ventilation hood in the microwave oven, is simplified.

Although the preferred embodiments of the present invention have been disclosed for illustrative purposes, those skilled in the art will appreciate that various modifications, addition and substitutions that are possible, without departing from the scope and spirit of the invention as disclosed in the accompanying claims.

What is claimed is:

1. A cooling system for a microwave oven including a cooking cavity, comprising:

an instrument compartment separated from the cooking cavity;

a first electronic equipment device positioned at an upper portion of said instrument compartment;

a second electronic equipment device positioned at a lower portion of said instrument compartment; and a fan assembly mounted to said instrument compartment, said fan assembly generating a downward air current and supplying the generated air current to both the first and second electronic equipment devices.

2. The cooling system of claim 1, wherein the fan assembly is mounted to an upper portion of said instrument compartment in the form of a slope.

3. The cooling system of claim 1, wherein the first electronic equipment device is a magnetron and the second electronic equipment device is a transformer and condenser.

4. The cooling system of claim 1, wherein the first electronic equipment device is a magnetron and the second electronic equipment device is a transformer or condensor.

5. The cooling system of claim 1, wherein the fan assembly supplies an air current to the first and second electronic equipment devices and the cooking cavity.

6. The cooling system of claim 1, wherein the rotary axis of the fan is not parallel to a lower panel of the instrument compartment.

7. A cooling system for a microwave oven including a cooking cavity, comprising:

an instrument compartment separated from the cooking cavity;

a first electronic equipment device positioned at an upper portion of said instrument compartment;

a second electronic equipment device positioned at a lower portion of said instrument compartment; and a fan assembly mounted to an upper portion of said instrument compartment in the form of a slope, said fan assembly generating an air current and supplying the generated air current to the first and second electronic equipment devices and the cooking cavity.

8. The cooling system of claim 7, wherein the first electronic equipment device is a magnetron and the second electronic equipment device is a transformer or condensor.

9. The cooling system of claim 7, wherein the first electronic equipment device is a magnetron and the second electronic equipment device is a transformer and condensor.

10. The cooling system of claim 7, wherein the fan assembly generates a downward air current.

11. The cooling system of claim 7, wherein the fan assembly supplies an air current to the cooking cavity without the assistance of additional equipment.

12. The cooling system of claim 7, wherein the rotary axis of the fan assembly is not parallel to a lower panel of the instrument compartment.

* * * * *